United States Patent [19]

Corel et al.

[11] Patent Number: 5,006,783

[45] Date of Patent: Apr. 9, 1991

[54] THREE PHASE VOLTAGE REGULATOR SYSTEM USING TERTIARY WINDING TRANSFORMER

[75] Inventors: Dale C. Corel, Elk Grove Village; Anthony Tamosaitis, Addison; Pradeep Narechania, Long Grove, all of Ill.

[73] Assignee: General Signal Corporation, Rochester, N.Y.

[21] Appl. No.: 421,903

[22] Filed: Oct. 16, 1989

[51] Int. Cl.[5] ..... G05F 1/30

[52] U.S. Cl. ..... 323/263; 323/237

[58] Field of Search ..... 336/5, 12; 323/255, 323/258, 259-263, 237, 215, 361

[56] References Cited

U.S. PATENT DOCUMENTS

| | | | |
|---|---|---|---|
| 963,132 | 7/1910 | Frank | 336/12 |
| 1,173,094 | 2/1916 | Blume . | |
| 1,412,782 | 4/1922 | Dwyer . | |
| 2,779,926 | 1/1957 | Johnson et al. | 336/5 |
| 3,215,961 | 11/1965 | Dortort | 336/12 |
| 3,432,725 | 3/1969 | Rotch | 323/242 |

FOREIGN PATENT DOCUMENTS

| | | |
|---|---|---|
| 182116 | 8/1986 | Japan . |
| 1310787 | 5/1987 | U.S.S.R. . |

*Primary Examiner*—William H. Beha, Jr.

*Attorney, Agent, or Firm*—Martin Lukacher; Milton E. Kleinman

[57] ABSTRACT

A three phase voltage regulator system uses a transformer having primary, secondary and tertiary windings for each phase which are closely magnetically coupled to each other and are connected to provide a four wire (wye) three phase output on three hot lines with a neutral line, and a three phase input which is also wye connected, but where the neutral need not be connected to an input neutral line. The voltage across each primary phase winding is regulated by a series connected regulator circuit. The regulator circuit may derive voltages from the respective tertiary winding which either bucks (subtracts from) or boosts (adds to) the input voltage so as to maintain the primary winding voltage substantially constant. A controller which is responsive to the output voltage from the secondary windings controls the regulators and responds to output voltages of their respective phases. The system output line to neutral voltages and line to line voltages are isolated from the input supply voltage and are not substantially affected by loading conditions (variations in the load connected to the secondary windings). The tertiary windings are connected in delta configuration to provide a path for the input neutral current, avoiding the need for a connection to an input neutral line, and help stabilize the output of the regulator system, while also extending the range of input voltages which can be regulated under unbalanced input voltage conditions.

5 Claims, 2 Drawing Sheets

THREE PHASE VOLTAGE REGULATOR SYSTEM USING TERTIARY WINDING TRANSFORMER

DESCRIPTION

Figure 1:
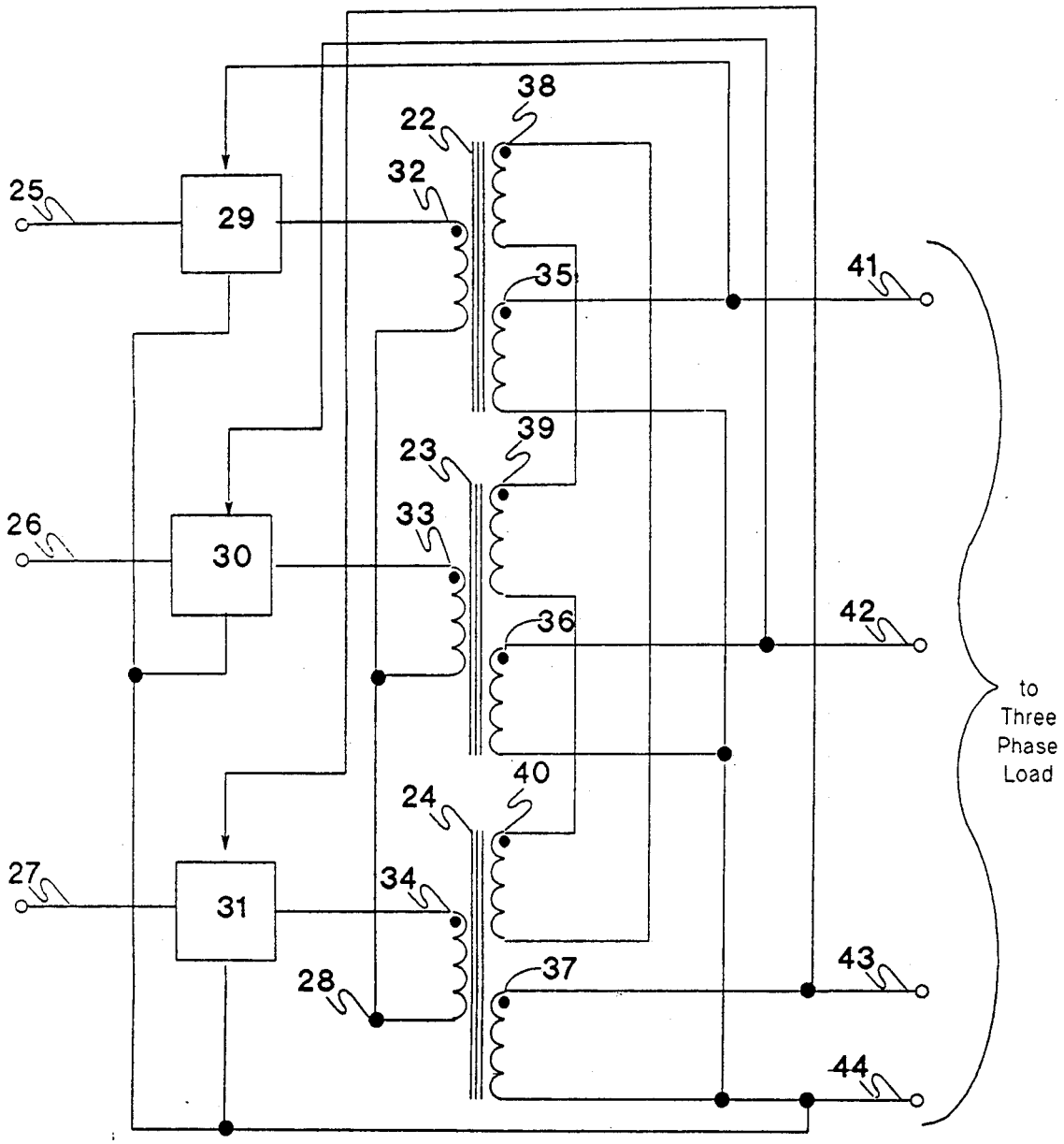

The present invention relates to three phase voltage regulating systems and particularly to a three phase regulator system which regulates output line to neutral voltages and line to line voltages in spite of input voltage imbalances.

The invention is especially suitable for providing a voltage regulator which provides a four wire three phase output where only three wires (no neutral) are available to supply input power; a common situation in many commercial buildings (a source neutral may not be available). The invention is generally useful wherever line to line and line to neutral voltages must be regulated in spite of imbalances in the source voltages for the respective phases.

Imbalance of phase voltages in three phase systems has long been a problem. If a transformer with wye connected primary windings and wye connected secondary windings is used to electrically isolate the output from the input, and if the source neutral is not connected to the transformer input neutral, then the output voltages of that transformer would be extremely sensitive to imbalances of the load connected to the secondary windings. This type of transformer would be unacceptable for use in a voltage regulating system. A degree of independence from loading conditions when a source neutral is not available is obtained through the use of tertiary windings. A tertiary winding in a three phase transformer is proposed in the following U.S. patents. Blume, U.S. Pat. No. 1,173,094, Feb. 22, 1916; Dwyer, U.S. Pat. No. 1,412,782, Apr. 11, 1922; Johnson, et. al. U.S. Pat. No. 2,779,926, Jan. 29, 1957; and Dortort, U.S. Pat. No. 3,215,961, Nov. 2, 1965. Attempts to use a delta connected primary and a wye connected secondary also provide a degree of independence from loading conditions. Output line to neutral voltages can be regulated. However, imbalances in the input voltages adversely affect the phase angles between the line to neutral output voltages, and consequently the line to line output voltages which are derived from the line to neutral output voltages so that such delta-wye connected regulators are not suitable for many three phase and single phase loads which require line to line voltages which are regulated. Delta-delta connected regulators require isolated sensing and control circuits for line to line regulation in addition to zig-zag connected secondary windings to provide an output neutral.

It is the principal object of the present invention to provide an improved three phase voltage regulating system capable of providing a four-wire electrically isolated three phase output while regulating both line to line and line to neutral voltages, even where only three wires are available (i.e., a floating neutral) to supply input power.

It is a further object of the invention to provide an improved three phase voltage regulating system which uses a tertiary winding where the output voltages, whether line to neutral or line to line, are independent of loading conditions so that the regulator can be used with many different types of loads both three phase and single phase, and especially where the independence from loading conditions is enhanced by closely or tightly magnetically coupling the tertiary windings and the primary and secondary windings for each phase.

It is a still further object of the present invention to provide an improved three phase voltage regulating system wherein imbalances in the input phase voltages are corrected with series regulating elements capable of either bucking (subtracting from) or boosting (adding to) the input phase voltages so as to keep them constant in response to line to neutral output voltages, thereby regulating both the line to neutral and line to line output voltages from the system.

Briefly described, a three phase voltage regulator system embodying the invention is adapted to regulate voltages supplied from a three wire source without a neutral. The system makes use of transformer means, preferably three transformers with wye connected primary windings adapted to be connected to a three wire input and wye connected secondary windings each having an output for connection to a three phase load. The secondary windings are wye connected for providing a neutral for connection to the load. The transformers also have preferrably delta connected, tertiary windings are closely coupled to both the primary windings and the secondary windings for each respective phase. The system has voltage regulating means, preferably connected in series with the primary windings and responsive to the line to neutral output voltages of their respective phases for keeping the voltages across the primary windings and the magnetic flux densities in the core or cores of the transformers at a constant level.

Figure 2:
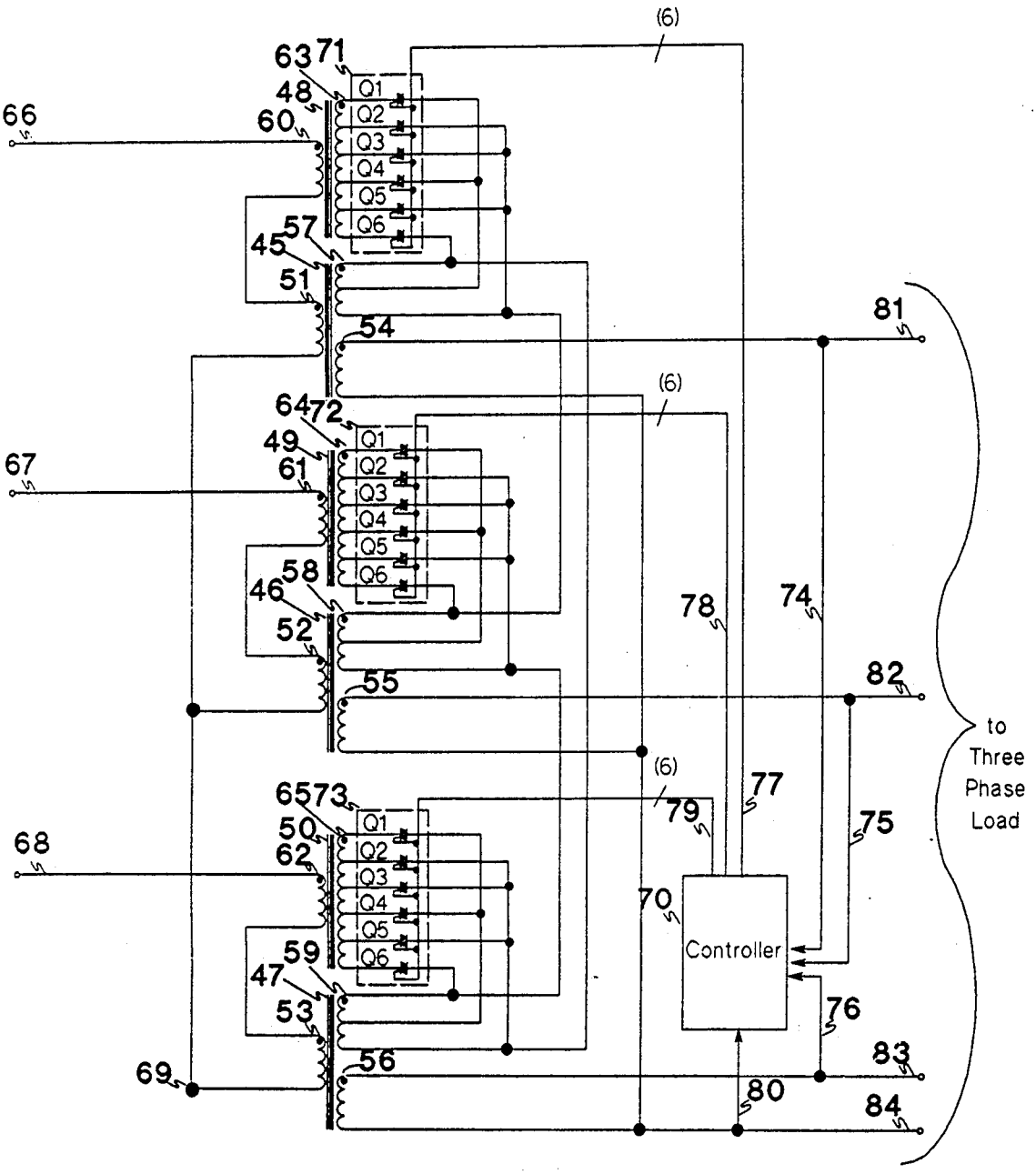

The foregoing and other objects, features and advantages of the invention as well as the presently preferred embodiment thereof, will become more apparent from a reading of the following description in connection with the accompanying drawings in which:

FIG. 1 is a simplified schematic diagram of a three phase voltage regulating system embodying the invention; and FIG. 2 is a more detailed diagram of a three phase voltage regulating system in accordance with a presently preferred embodiment of the invention.

Referring to FIG. 1, there is shown a three phase voltage regulating system which can regulate output line to line voltages (41–42, 42–43, 43–41) in spite of imbalances in the line to line input voltages (25–26, 26–27, and 27–25). As will become more apparent as the description proceeds, such regulation occurs since the phase angles of the output voltages are ultimately a function of only the output voltage regulation which is detected and controlled. The degree of independence from the uncontrolable magnitudes of the input voltages is only limited by the regulators output voltage regulation characteristics which in turn are only limited by the capabilities of series regulators 29, 30 and 31 which keep the voltages across the primaries 32, 33 and 34 of transformers 22, 23 and 24 and the magnetic flux densities in the cores of these transformers at a constant level.

The system is capable of being supplied by a three wire input which is connected to input terminals of the lines 25, 26 and 27. The system provides an electrically isolated four wire output at the output lines 41, 42 and 43, including a neutral 44, which is relatively independent of loading conditions. The load is a three phase load which is connected to output terminals of these lines. The lines are connected to the secondary windings 35, 36 and 37 of the transformers 22, 23 and 24.

An alternate path for what would normally be the input neutral current, there being a floating neutral 28, is established through the addition of a tertiary winding which is provided by delta connected tertiary windings 38, 39 and 40. These windings are wound on the cores of each of the wye-wye connected transformers 22, 23 and 24. The tertiary windings are closely coupled to their respective primary and secondary windings. Thus, for example, when three independent single phase transformers are used to provide the wye-wye connected transformers, the tertiary winding may be wound on top of its respective primary with the respective secondary winding wound on top of its respective tertiary winding.

Line-neutral load current induces a circulating current around the delta interconnected tertiary windings which in turn induces a current in all of the primary windings 32, 33 and 34. The net effect of this action is that the need for an input neutral conductor, which would normally be connected to the neutral junction 28, is eliminated, since the input current of this wye-wye transformer topology is redistributed among the three input phase lines 25, 26 and 27. Then the output line to neutral voltages 41–44, 42–44 and 43–44 are not dependent upon loading conditions. Independence from loading conditions of the system output line to neutral voltages is obtained because the tertiary windings are tightly coupled to their respective primary and secondary windings.

In addition to providing an alternate path for input neutral current, the tertiary windings provide the added benefits of partially balancing the input line currents, helping stabilize the output of the system and extending the input voltage range of the regulator system under unbalanced input voltage conditions beyond that for balanced input voltage conditions.

The series regulators 29, 30 and 31 are responsive to the output voltages from the secondary windings (the line to neutral voltages 41–44, 42–44, and 43–44) of their respective phases. The system, because the input voltages across the primary windings 32, 33 and 34 are maintained constant, regulates not only the line to neutral output voltages but also the line to line output voltages.

Referring to FIG. 2, there is shown a voltage regulator having a three phase input on lines 66, 67 and 68 and which does not require a neutral. There is no connection to the neutral junction 69 of the wye connected transformers 45, 46 and 47 of the system. The system also has a three phase output on lines 81, 82 and 83 and neutral line 84. These lines are connected to the secondary windings 54, 55 and 56 of the transformers 45, 46 and 47. Delta connected tertiary windings 57, 58 and 59 are also used. These windings are tapped since the voltages across these tertiary windings are used to regulate the input voltages across the primary windings 51, 52 and 53, as will be explained more fully hereinafter.

The series regulators are provided by auxiliary transformers 48, 49 and 50 having primary windings 63, 64 and 65 having a plurality of taps which are connected through switching means (an electronic tap changing system) 71, 72 and 73 to the tertiary windings 57, 58 and 59. The tap changing, switching means is responsive to the output line to neutral voltages which are connected to a controller 70. The controller is connected by cables 77, 78 and 79 to the control or gate electrodes of triacs or thyristors which provide the switching means 71, 72 and 73.

The system output is taken from the secondary windings 54, 55 and 56 of the main transformers 45, 46 and 47. The line-neutral voltages across the secondary windings (81–84, 82–84, and 83–84) of the main transformers are kept constant (preferably but not necessarily to within ±5% of the desired output voltage level) because the voltages across the primary windings 51, 52 and 53 of the main transformers 45, 46 and 47 are kept constant, via control of the voltages across the auxiliary transformers 48, 49 and 50 which have their secondary windings 60, 61 and 62 connected in series with the main transformer primary windings 51, 52 and 53. The auxiliary transformers 48, 49 and 50 act as buck/boost transformers, bucking or boosting the system input voltage as required to keep the main transformer primary voltages constant. The auxiliary transformer applies voltages from the tertiary windings 57, 58 and 59 of selected amplitude and polarity because the triacs or thyristors in the switching means 71, 72 and 73 are selectively switched or fired by drive signals from the controller 70.

In operation, the controller preferably using individual microprocessors for the respective phases, selects two of the triacs or thyristors of each of the switching means 71, 72 and 73 to conduct current to the auxiliary transformer primary windings 63, 64 and 65. Since the magnitude and polarity of the voltage is controlled at the primaries 63, 64 and 65 of the auxiliary transformers, the voltages across the secondaries 60, 61 and 62 are similarly controlled and boost or buck the input line voltages so as to maintain the voltages across the primaries 51, 52 and 53 of the main transformer 45, 46 and 47 constant. The voltages being constant, the magnetic flux densities in the cores of these transformers is also maintained at a constant level. The selection of which two triacs or thyristors associated with a particular phase will conduct is a function of the line neutral output voltage of that respective phase, as given in the table below. The output voltage of each phase is independently sampled and controlled by its respective microprocessor.

A regulator with an output voltage range of 120 V ±5% for an input range of 120 V +15% / −25% may have 7 tap conditions. A tap condition is defined by a unique pair of triacs or thyristors conducting current to the auxiliary transformers 48, 49, 50. Each switching means 71, 72, 73 has six triacs or thyristors labled Q1 through Q6. The following is a decision table which each microprocessor uses to determine which two triacs or thyristors, associated with a particular phase, will conduct.

| Initial Tap Condition | | Output Voltage | Final Tap Condition | |
|---|---|---|---|---|
| # | Devices | Range | # | Devices |
| 1 | Q5 & Q4 | 114≦V≦126 | 1 | Q5 & Q4 |
| | | 107≦V<114 | 2 | Q5 & Q1 |
| | | 100≦V<107 | 3 | Q5 & Q3 |
| | | 94≦V<100 | 4 | Q6 & Q1 |
| | | 88≦V<94 | 5 | Q6 & Q4 |
| | | 83≦V<88 | 6 | Q6 & Q2 |
| | | V<83 | 7 | Q6 & Q3 |
| 2 | Q5 & Q1 | V>126 | 1 | Q5 & Q4 |
| | | 114≦V≦126 | 2 | Q5 & Q1 |
| | | 107≦V<114 | 3 | Q5 & Q3 |
| | | 100≦V<107 | 4 | Q6 & Q1 |
| | | 94≦V<100 | 5 | Q6 & Q4 |
| | | 88≦V<94 | 6 | Q6 & Q2 |
| | | V<88 | 7 | Q6 & Q3 |
| 3 | Q5 & Q3 | V>134 | 1 | Q5 & Q4 |

-continued

| Initial Tap Condition # | Devices | Output Voltage Range | Final Tap Condition # | Devices |
|---|---|---|---|---|
| | | 126<V≦134 | 2 | Q5 & Q1 |
| | | 114≦V≦126 | 3 | Q5 & Q3 |
| | | 107≦V<114 | 4 | Q6 & Q1 |
| | | 100≦V<107 | 5 | Q6 & Q4 |
| | | 94≦V<100 | 6 | Q6 & Q2 |
| | | V<94 | 7 | Q6 & Q3 |
| 4 | Q6 & Q1 | V>142 | 1 | Q5 & Q4 |
| | | 134<V≦143 | 2 | Q5 & Q1 |
| | | 126<V≦134 | 3 | Q5 & Q3 |
| | | 114≦V≦126 | 4 | Q6 & Q1 |
| | | 107≦V<114 | 5 | Q6 & Q4 |
| | | 100≦V<107 | 6 | Q6 & Q2 |
| | | V<100 | 7 | Q6 & Q3 |
| 5 | Q6 & Q4 | V>152 | 1 | Q5 & Q4 |
| | | 143<V≦152 | 2 | Q5 & Q1 |
| | | 134<V≦143 | 3 | Q5 & Q3 |
| | | 126<V≦134 | 4 | Q6 & Q1 |
| | | 114≦V≦126 | 5 | Q6 & Q4 |
| | | 107≦V<114 | 6 | Q6 & Q2 |
| | | V<107 | 7 | Q6 & Q3 |
| 6 | Q6 & Q2 | V>162 | 1 | Q5 & Q4 |
| | | 152<V≦162 | 2 | Q5 & Q1 |
| | | 143<V≦152 | 3 | Q5 & Q3 |
| | | 134<V≦143 | 4 | Q6 & Q1 |
| | | 126<V≦134 | 5 | Q6 & Q4 |
| | | 114≦V≦126 | 6 | Q6 & Q2 |
| | | V<114 | 7 | Q6 & Q3 |
| 7 | Q6 & Q3 | V>173 | 1 | Q5 & Q4 |
| | | 162<V≦173 | 2 | Q5 & Q1 |
| | | 152<V≦162 | 3 | Q5 & Q3 |
| | | 143<V≦152 | 4 | Q6 & Q1 |
| | | 134<V≦143 | 5 | Q6 & Q4 |
| | | 126<V≦134 | 6 | Q6 & Q2 |
| | | 114≦V≦126 | 7 | Q6 & Q3 |

In addition to the multi-tapped buck-boost auxiliary transformers, other regulating means such as magnetic amplifiers, pulse width modulated controls, pulse position modulated controls, and linear electronic power amplifiers may alternatively be used. Also, instead of single phase transformers, the main transformers may be consolidated into a single three phase transformer and the auxiliary transformers consolidated into another three phase transformer on a three phase core. Alternatively, the main transformer flux can be controlled with a multi-tapped primary mounted directly on the main transformer core thus integrating the series regulating element and the main transformer into one structure. The transformer windings may be series-parallel connectable for consolidation of voltage ratings.

From the foregoing description it will be apparent that the improved voltage regulating system provides the following advantages:

1. Facilitating line-line output voltage regulation of any three phase voltage regulating system providing isolation, a three wire input and a four wire output.

2. Redistribution of load current to help equalize input line currents thus reducing the severity of thermal stress on what would normally be the most severely stressed input conductor(s) under unbalanced load conditions.

3. Reduction of thermal stress acting on what would normally be the most severely stressed current carrying component(s) within any three phase voltage regulating system as a result of the redistribution of load currents.

4. Eliminating the need for an input neutral conductor connecting the source to the three phase voltage regulating system.

5. Allowing the user to avoid proper sizing of an input neutral conductor, in order to accommodate harmonics generated by his load, as a consequence of eliminating the need for an input neutral conductor.

6. Eliminating the need for electrically isolated voltage sensing circuitry associated with the operation of the three phase voltage regulating system.

7Eliminating the need for electrically isolated voltage control circuitry associated with the operation of the three phase voltage regulating system.

8. Extending the input voltage range of the three phase voltage regulating system.

9. Enhancing the stability of the three phase voltage regulating system.

What is claimed is:

1. A three phase voltage regulator adapted to regulate voltages supplied from a three wire input source without a neutral which comprises transformer means having three phase primary windings and three phase secondary windings, said secondary windings having an output for connection to a three phase load, said transformer means also having a three phase tertiary winding having three windings at least individual ones of which are coupled to said primary windings and said secondary windings, so as to provide coupled primary, secondary and tertiary windings for each respective phase, voltage regulating means connected to said primary windings for keeping the voltage across said primary windings substantially constant, wherein said regulating means is connected in series with said primary windings, and wherein said regulating means comprises means for applying voltage form said tertiary windings to said primary windings.

2. A three phase voltage regulator adapted to regulate voltages supplied from a three wire input source without a neutral which comprises transformer means having three phase primary windings and three phase secondary windings, said secondary windings having an output for connection to a three phase load, said transformer means also having a three phase tertiary winding having three windings at least individual ones of which are coupled to said primary windings and said secondary windings, so as to provide coupled primary, secondary and tertiary windings for each respective phase, voltage regulating means connected to said primary windings for keeping the voltage across said primary windings substantially constant, said regulating means being responsive to the voltage at the output of said secondary windings and comprising three regulating means respectively connected to the primary windings of a different one of said phases, said three regulating means being connected in series with their respective primary windings, and wherein said regulating means each comprises means for applying voltage from the one of said tertiary windings in series with the primary windings for its respective phase.

3. A three phase voltage regulator adapted to regulate voltages supplied from a three wire input source without a neutral which comprises transformer means having three phase primary windings and three phase secondary windings, said secondary windings having an output for connection to a three phase load, said transformer means also having a three phase tertiary winding having three windings at least individual ones of which are coupled to said primary windings and said secondary windings, so as to provide coupled primary, secondary and tertiary windings for each respective phase, voltage regulating means connected to said primary windings for keeping the voltage across said primary windings substantially constant, wherein regulating means comprises three regulating means respectively connected to the primary windings of a different one of said phases, wherein said three regulating means are connected in series with their respective primary windings, wherein said regulating means each comprises means for applying voltage from the one of said tertiary windings in series with the primary windings for its respective phase, and wherein said applying means each includes means responsive to the output voltage of the secondary winding for its respective phase.

4. The invention in accordance with claim 3, wherein said applying means for each respective phase comprises an auxiliary transformer having a primary winding connected to the tertiary winding of the respective phase and a secondary winding connected in series with the primary winding of the transformer means of that respective phase.

5. The invention in accordance with claim 4, wherein said primary winding of said auxiliary transformer has a plurality of taps and said tertiary winding has at least one tap, output switching means connecting said tertiary windings and said taps thereof to said primary winding and taps thereof of said auxiliary transformer, and controller means responsive to said output voltage of said secondary winding for selectively operating said switching means to develop voltages of selected magnitude and polarity across the secondary winding of said auxiliary transformer.

* * * * *